US008533909B2

(12) United States Patent
Minegishi et al.

(10) Patent No.: US 8,533,909 B2
(45) Date of Patent: Sep. 17, 2013

(54) DOOR OPENING AND CLOSING DEVICE

(75) Inventors: Eita Minegishi, Hiratsuka (JP); Satoru Shibata, Hiratsuka (JP)

(73) Assignee: The Yokohama Rubber Co., Ltd. (JP)

( * ) Notice: Subject to any disclaimer, the term of this patent is extended or adjusted under 35 U.S.C. 154(b) by 469 days.

(21) Appl. No.: 12/776,587

(22) Filed: May 10, 2010

(65) Prior Publication Data

US 2010/0313482 A1 Dec. 16, 2010

(30) Foreign Application Priority Data

Jun. 12, 2009 (JP) ..... 2009-141667

(51) Int. Cl.
*E05F 1/10* (2006.01)

(52) U.S. Cl.
USPC ..... 16/76; 16/72

(58) Field of Classification Search
USPC ..... 16/76, 72, 71, 78, 50, 277, 304, 305, 16/306, 307, 386, DIG. 10, DIG. 17, 285, 16/75; 160/199, 206, 234, 229.1; 244/129.5, 244/118.5, 131
See application file for complete search history.

(56) References Cited

U.S. PATENT DOCUMENTS

| | | | | |
|---|---|---|---|---|
| 132,133 | A * | 10/1872 | Bliss | 16/76 |
| 495,966 | A * | 4/1893 | Ennis | 16/307 |
| 5,606,774 | A * | 3/1997 | Wu | 16/366 |
| 6,256,839 | B1 * | 7/2001 | Wu | 16/366 |
| 6,460,220 | B1 * | 10/2002 | Jackson | 16/285 |
| 6,618,902 | B2 * | 9/2003 | Wu | 16/298 |
| 6,732,408 | B2 * | 5/2004 | Wu | 16/298 |
| 2009/0199363 | A1 * | 8/2009 | Conway et al. | 16/285 |

FOREIGN PATENT DOCUMENTS

| | | |
|---|---|---|
| JP | S62-169168 | 10/1987 |
| JP | 05-151841 | 6/1993 |
| JP | H10-317777 | 12/1998 |
| JP | 2010-037735 | 2/2010 |

OTHER PUBLICATIONS

Japanese Office Action dated Mar. 19, 2013, 6 pages, Japan.

* cited by examiner

*Primary Examiner* — Jeffrey O Brien
(74) *Attorney, Agent, or Firm* — Thorpe North & Western LLP

(57) ABSTRACT

Coil springs are incorporated, with a longitudinal direction oriented vertically, into the top and bottom end parts of hinge pieces provided on side surfaces of opposing door panels of a folding door and that connect the doors panels together. A portion of a pin plate is inserted into the coil springs at the top and bottom end parts of the coil springs and attached to the coil springs. The pin plate that is inserted into the top end part of the coil spring incorporated into the top end part of the hinge piece and the pin plate that is inserted into the bottom end part of the coil spring incorporated into the bottom end part of the hinge piece are fixed to the hinge pieces by brackets. The folding door is closed by the restoring force generated by the twisting of the coil springs.

20 Claims, 6 Drawing Sheets

DOOR OPENING AND CLOSING DEVICE

PRIORITY CLAIM

This application is based upon and claims the benefit of priority from Japanese Patent Application No. 2009-141667, filed Jun. 12, 2009, the entire contents of which is incorporated herein by reference.

TECHNICAL FIELD

The present invention relates to a door opening and closing device with a mechanism that connects door panels of a folding door together and automatically closes the door, and particularly relates to a door opening and closing device with excellent durability that can easily be attached or removed from the door panels.

BACKGROUND OF THE INVENTION

The space in lavatories of aircraft and the like is severely restricted, so lavatories are required to be as compact as possible. Therefore, doors are folding doors that do not require a large space in which to move. The folding doors mounted on these lavatories have a mechanism that automatically closes an open door in order to ensure safety and to block unpleasant odors (see Japanese Unexamined Patent Application Publication No. H7-11836).

The folding door of Japanese Unexamined Patent Application Publication No. H7-11836 uses coil springs in a door closing mechanism that automatically closes open doors. Conventionally, door closing mechanisms that automatically close open doors, such as the invention of Japanese Unexamined Patent Application Publication No. H7-11836, use coil springs as so-called torsion springs. As such, when opening or closing the door, stress accumulates around regions where helical wound wires formed at top and bottom ends of the coil springs is stretched straight, and thus the top and bottom ends of the coil springs are easily damaged, which has been a cause of reduced durability. Furthermore, there is a demand for a door opening and closing device that can be more easily attached and removed from the door panels.

SUMMARY OF THE INVENTION

An object of the present invention is to provide a door opening and closing device with a mechanism having superior durability that can automatically close a door, and that can be easily attached to or removed from door panels of a folding door.

In order to achieve the aforementioned object, the door opening and closing device is provided with coil springs incorporated with a longitudinal direction orientated in a vertical direction into each of a top end part and a bottom end part of hinge pieces that rotatably connect the door panels of the folding door together; pin plates, having a portion thereof inserted into the coil springs in a top end part and a bottom end part of the coil springs so as to protrude in the longitudinal direction of the coil springs, attached to the coil springs; and brackets that fix the hinge pieces to the pin plate protruding from the top end part of the coil spring incorporated into the top end part of the hinge piece and to the pin plate protruding from the bottom end part of the coil spring incorporated into the bottom end part of the hinge piece; wherein the folding door is closed by a restoring force generated by a twisting of the coil springs.

Here, a specification wherein a shaft is inserted into each of the coil springs is also possible. It is also possible to have a specification with a shaft divided partway in the longitudinal direction. A top part of the divided shaft is connected to the pin plate that is inserted into the top end part of the coil spring, and a bottom part of the divided shaft is connected to the pin plate that is inserted into the bottom end part of the coil spring. A specification where the top part of the divided shaft and the bottom part of the divided shaft can move relatively to each other in a shaft axial direction is also possible.

With the present invention, the coil springs that function to automatically close the door are incorporated with the longitudinal direction oriented vertically in two locations, namely the top end part and the bottom end part of the hinge pieces that rotatably connect the door panels of a folding door together. Also, the door opening and closing device according to the present invention can be relatively easily attached to and removed from the door panels of the folding door because the pin plates have a portion thereof inserted into the coil springs and protrude out in the longitudinal direction of the coil springs in both the top end part and the bottom end part of the coil springs; are fixed to the coil springs; and the pin plate protruding from the top end part of the coil spring that is incorporated into the top end part of the hinge piece and the pin plate protruding from the bottom end part of the coil spring that is incorporated into the bottom end part of the hinge piece are attached to the hinge pieces by the brackets.

Furthermore, when the coil springs are twisted by opening and closing the door, the portions of the pin plates that are inserted into the coil springs are constricted at the top end part and the bottom end part of the coil springs by a tightening of the coil springs. Therefore, the coil springs corresponding to these portions are integrated with the pin plates and are supported by the pin plates, enabling occurrences of excessive stress concentration in the coil springs to be avoided. As a result, premature breaking of the coil springs due to repeated opening and closing of the door can be prevented, and durability can be improved.

DETAILED DESCRIPTION

The door opening and closing device of the present invention is described below based on embodiments shown in the figures.

Figure 1:
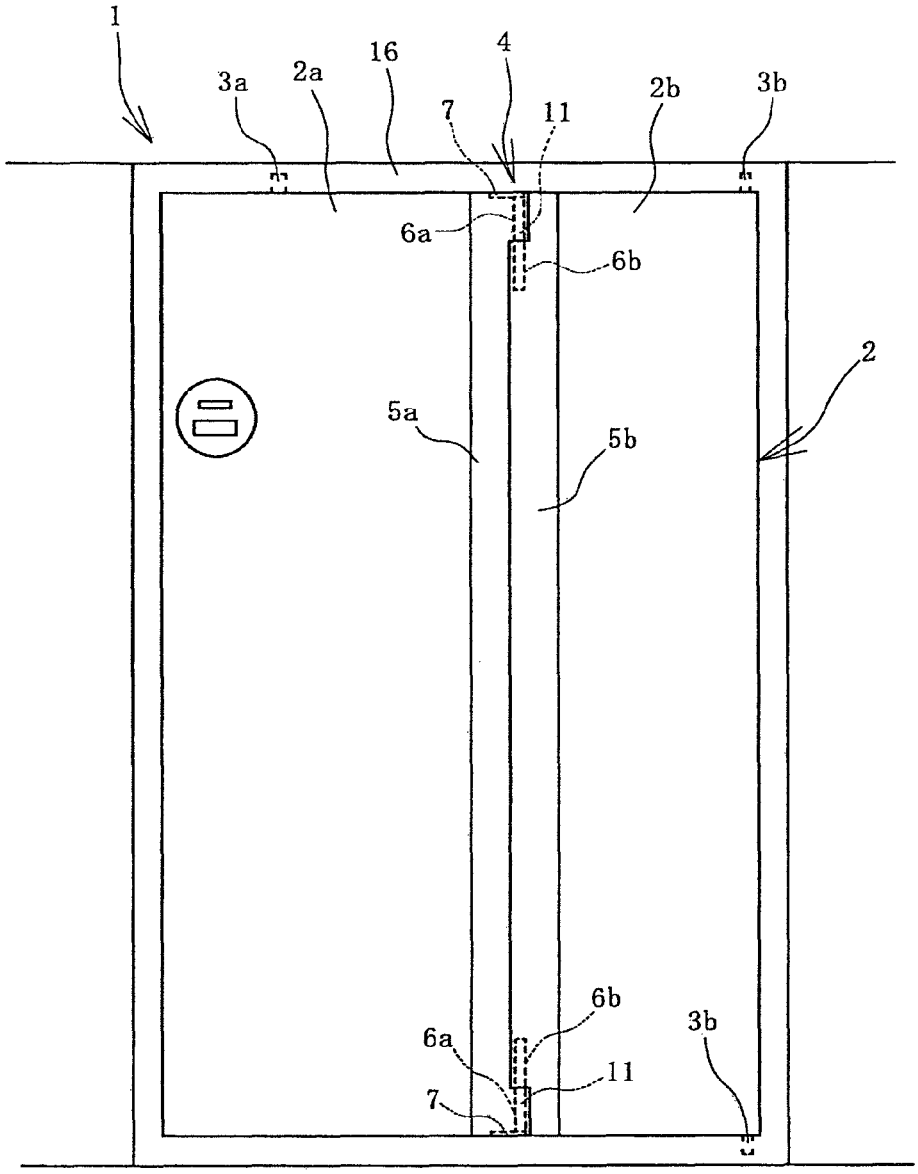
FIG. 1 is a front view illustrating a folding door.
Figure 2:
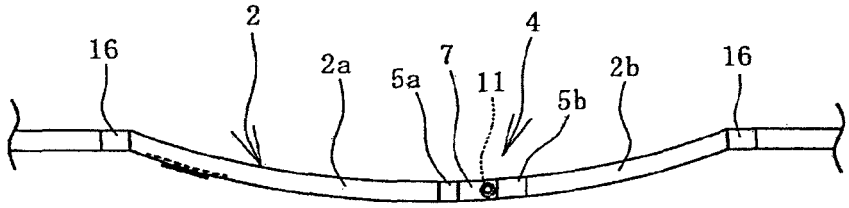
FIG. 2 is a top plan view of the folding door of FIG. 1.

As illustrated in FIG. 1 and FIG. 2, a door opening and closing device 4 of the present invention is attached to a folding door 2 (hereinafter referred to as door 2) that is used on an aircraft lavatory 1. Two door panels 2*a*, 2*b* that constitute the door 2 are connected by the door opening and closing device 4. Each of the door panels 2*a*, 2*b* has a curved surface expanding outward in an arc shape. By forming the door panels 2*a*, 2*b* with outward-expanding curved surfaces, a large space can be secured inside of the door 2. The present invention is not limited to the door panels 2*a*, 2*b* with curved surfaces, and can also be applied to flat door panels.

A guide shaft 3*a* inserted into a top surface of the first door panel 2*a* slides in left and right directions along a guide rail provided on a top edge of an attachment frame 16, and a second door panel 2*b* has a construction that is axially supported by the top edge and a bottom edge of the attachment frame 16 by a rotating shaft 3*b*.

The door opening and closing device 4 has hinge pieces 5*a*, 5*b* that are fixed to opposing side surfaces of the door panels 2*a*, 2*b*. The hinge pieces 5*a*, 5*b* have a construction such that the top and bottom end parts thereof are mutually interlocked. Attachment holes 6*a*, 6*b* are formed in the mutually interlocked regions.

Figure 3:
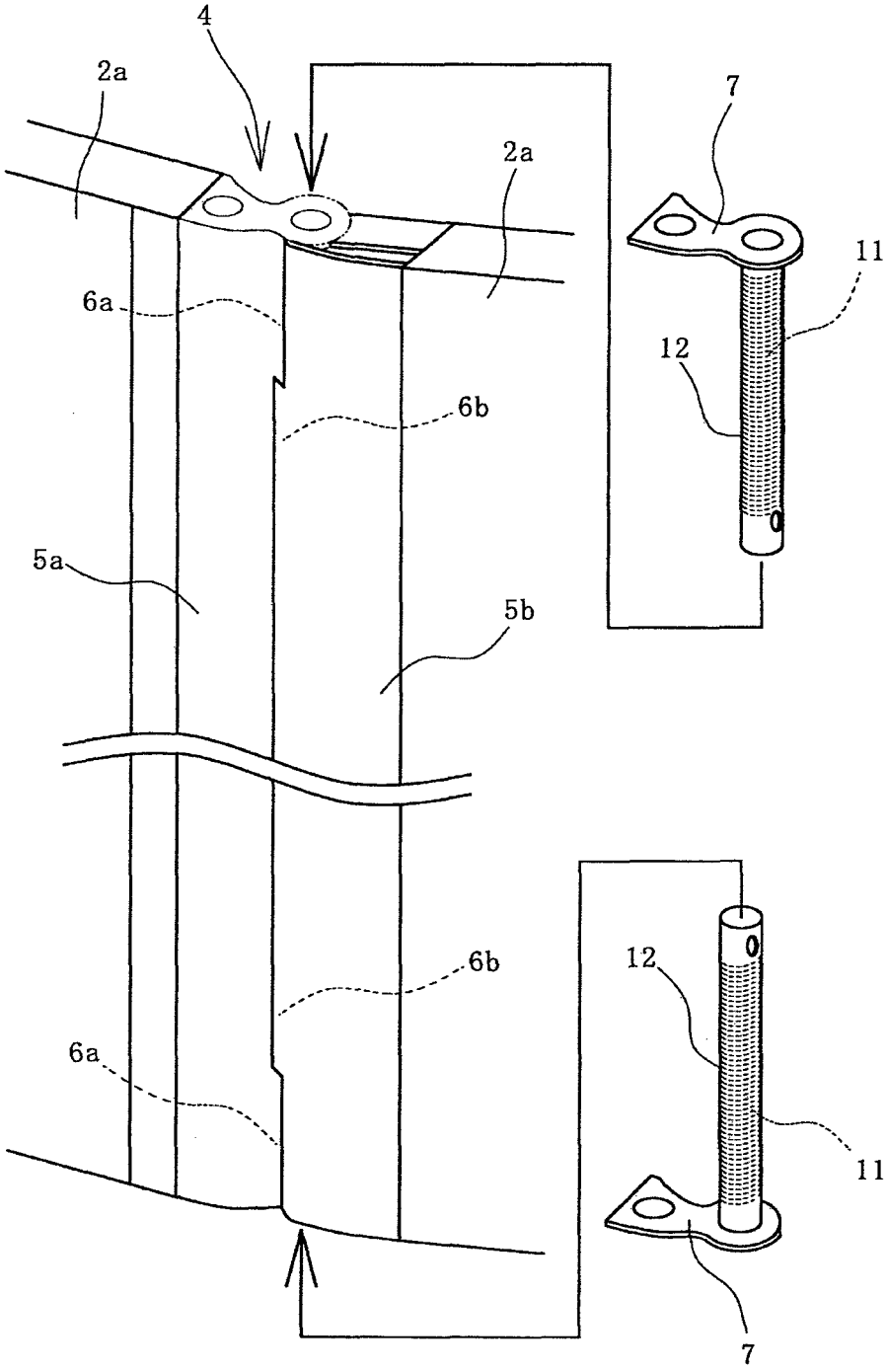
FIG. 3 is an explanatory diagram illustrating a process of attaching a door opening and closing device of the present invention.

The hinge pieces 5*a*, 5*b* are assembled so that the attachment holes 6*a*, 6*b* are vertically aligned. Furthermore, as illustrated in FIG. 3, housings 12 that incorporate the coil springs 11 are made to pass through the attachment holes 6*a*, 6*b*, and are attached to the hinge pieces 5*a*, 5*b*. As the housings 12 incorporating the coil springs 11 are attached to the top end part and the bottom end part of the hinge pieces 5*a*, 5*b* in a similar fashion, a description of the housing 12 attached to the top end part will be serve to illustrate both.

Figure 4:
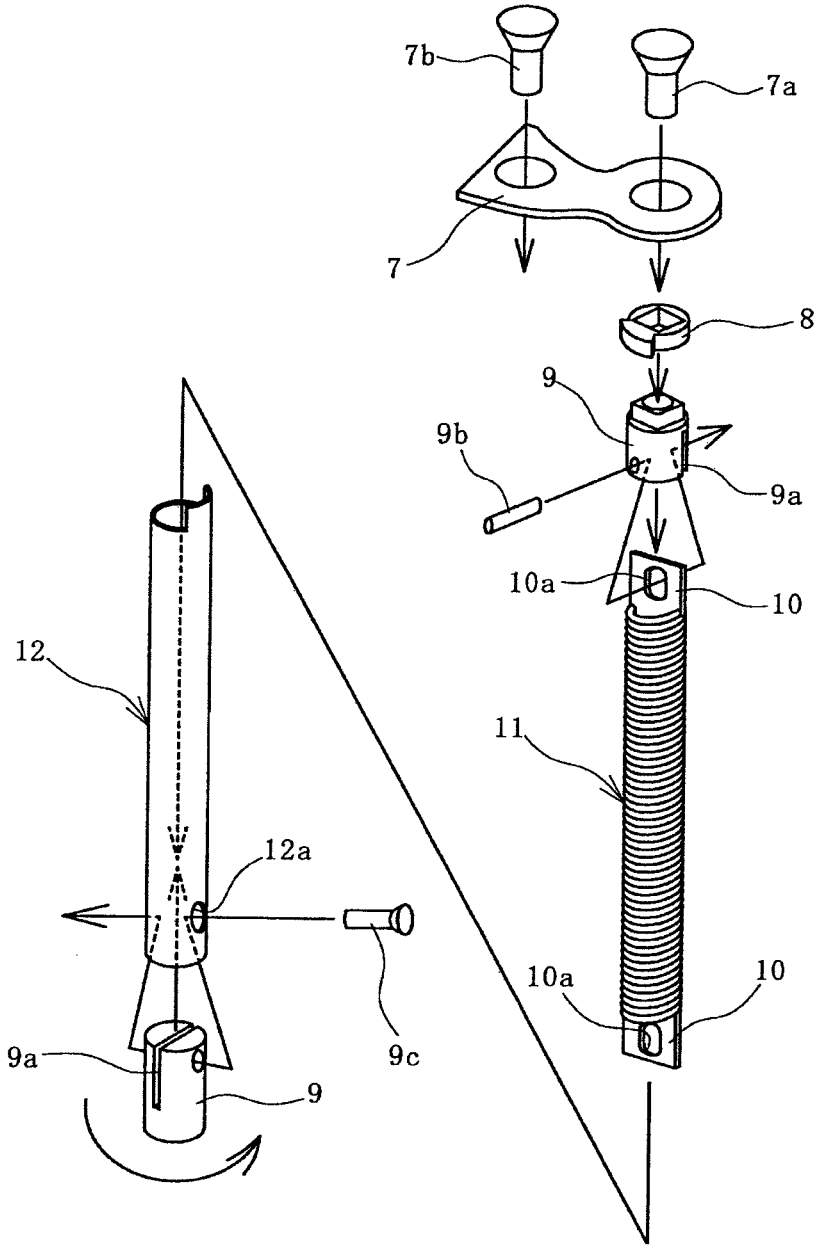
FIG. 4 is an explanatory diagram illustrating an internal construction of the door opening and closing device of the present invention.
Figure 5:
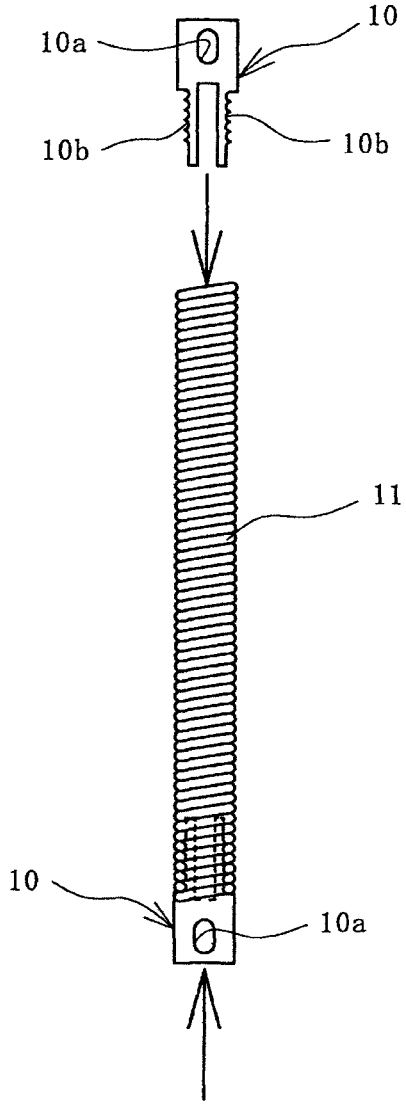
FIG. 5 is an explanatory diagram illustrating a process of inserting a pin plate into a coil spring.
Figure 6:
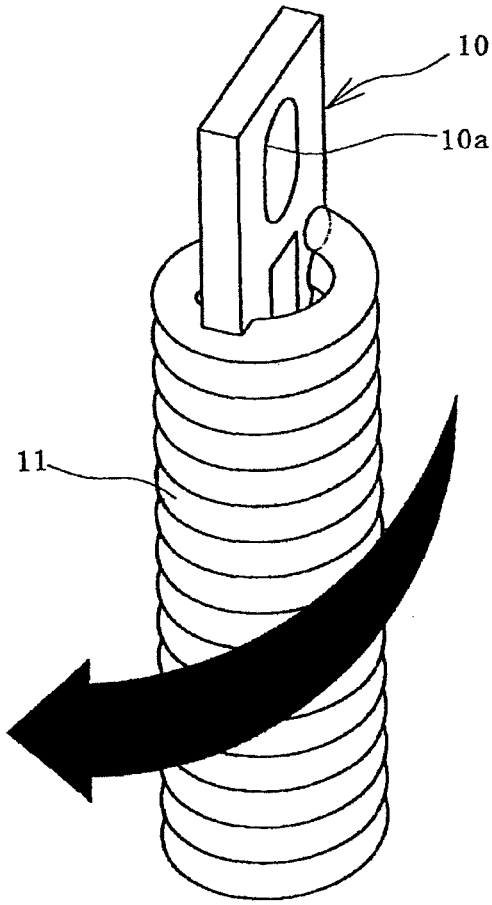
FIG. 6 is an explanatory diagram illustrating an engagement condition between a pin plate and a coil spring.

As illustrated in FIG. 4 through FIG. 6, the coil spring 11 into which the pin plates 10 are inserted in the top and bottom end parts is incorporated into the housing 12. Elongate holes 10*a* and vertically extending engagement grooves 10*b* are formed in the pin plates 10. The pin plates 10 are attached to the coil spring so that the engagement grooves 10*b* engage with the inner circumferential surface of the coil spring 11 with the elongate holes 10*a* protruding from the coil spring 11. End surfaces of vertical ends of a helical wire that forms the coil spring 11 are constructed so as to be in contact with the surfaces of the pin plates 10 in order to lock to the coil spring 11 and the pin plates 10 together.

An outer diameter of the coil spring 11 is, for example, from approximately 9 mm to 15 mm, and a length is from approximately 100 mm to 120 mm. A length of the portion of the pin plates 10 inserted into the coil spring 11 (portion corresponding to the engagement grooves 10*b*) is, for example, from approximately 10 mm to 15 mm.

The portion of the elongate hole 10*a* of the pin plate 10 provided in the top end part of the coil spring 11 is inserted into slots 9*a* of a fitting 9. The fitting 9 and the pin plate 10 are connected by a pin 9*b* that passes through the elongate hole 10*a*. A cam 8 is interposed in a top part of this fitting 9, and a bracket 7 is attached by a screw 7*a*. In this manner, the pin plate 10 and the bracket 7 are integrated. The bracket 7 is fixed to the door panel 2*a* by a separate screw 7*b*.

A fan shaped cutaway is formed in the cam 8, and a cutaway is also formed in a top end part of the housing 12. These cutaways are interlocked so that an angle of rotation of the cam 8 (door panels 2*a*, 2*b*) is restricted.

A portion of the elongate hole 10*a* of the pin plate 10 provided in the bottom end part of the coil spring 11 is similarly inserted into the slots 9*a* of the fitting 9. Furthermore, the fitting 9 and the pin plate 10 are connected by a screw 9*c* that passes through the elongate hole 10*a* and the elongate hole 12*a* of the housing 12. At this time for example, the fitting 9 of the bottom side (pin plate 10) is fixed to the housing 12 in a position that rotates 180 degrees around the coil axial center with respect to the top side fitting 9 (pin plate 10).

In this way, the housing 12 incorporating the coil spring 11 and the like is attached to the hinge pieces 5*a*, 5*b* with the attachment holes 6*a*, 6*b* in an aligned state. The bottom end part of the hinge pieces 5*a*, 5*b* also have the same construction, and herein, the pin plate 10 that is inserted into a bottom end part of the coil spring 11 is fixed to the hinge piece 5*a* by the bracket 7.

When the first door panel 2*a* is pressed from the outside, the door panels 2*a*, 2*b* will rotate around the door opening and closing device 4, and the door 2 will open. At this time, the coil springs 11 are twisted by the brackets 7 that are connected to the door panel 2*a*. Thus, when pressure on the door panel 2*a* is released, the brackets 7 and the door panel 2*a* will return to their original positions due to of the restoring force of the twisted coil springs 11, and the door 2 will automatically close.

To install the door opening and closing device 4 of the present invention to the door panels 2*a*, 2*b*, the coil springs 11 with inserted pin plates 10 in the top and bottom end parts as described above need only be attached at two locations, namely the top end part and the bottom end part of the hinge pieces 5*a*, 5*b* and the corresponding brackets 7 affixed to the door panel 2*a*, so the operation can be completed in a relatively few number of steps, with no complicated processes. Furthermore, to remove the door opening and closing device 4, a procedure that is the reverse of the installation operation need only be performed, so the operation can be completed in a relatively few number of steps, with no complicated processes. As such, the components constituting the door opening and closing device 4, such as the coil springs 11, brackets 7, and the like, can be quickly replaced.

In this embodiment, a unit that incorporates the coil springs 11, the pin plates 10, the fittings 9, and the cam 8 in the housing 12 can simply be attached to the attachment holes 6*a*, 6*b* of the hinge pieces 5*a*, 5*b*, further simplifying the installation process.

In the present invention, when the coil springs 11 are twisted by the opening and closing of the door 2, the portions of the pin plates 10 that are inserted in the top end part and the bottom end part of the coil springs 11 (portions corresponding to the engagement grooves 10*b*) are constricted by the tightening coil springs 11. Specifically, when the coil springs 11 are twisted by the pin plates 10 that are attached to the coil springs 11, the tightening of the coil springs 11 will gradually proceed from the end parts toward a center part in an coil axial direction.

If both end parts of the coil springs 11 are twisted without the pin plates 10 inserted, excessive stress concentration will occur at both end parts of the coil springs 11, the axial direction of the coil springs 11 will not be able to maintain a straight line, and warping or other effects will occur, leading to a risk of premature damage. In the present invention, the portions of the coil springs 11 that constrict the pin plates 10 are integrated with and supported by the pin plates 10, thus preventing the accumulation of excessive stress in the coil springs 11. Therefore, the occurrence of premature damage to the coil springs 11 due to repeated openings and closings of the door 2 will be reduced, thus improving durability.

Figure 7:
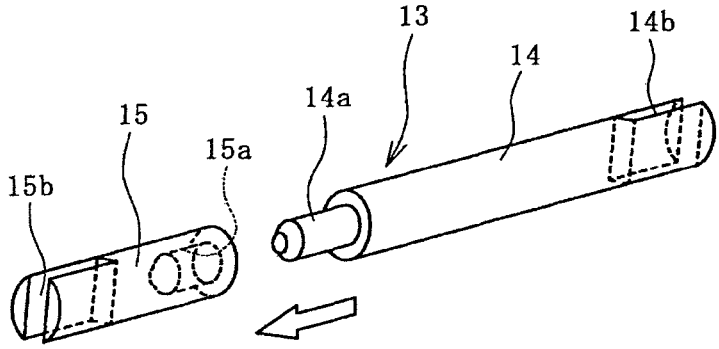
FIG. 7 is an explanatory diagram illustrating an insert shaft mechanism.
Figure 8:
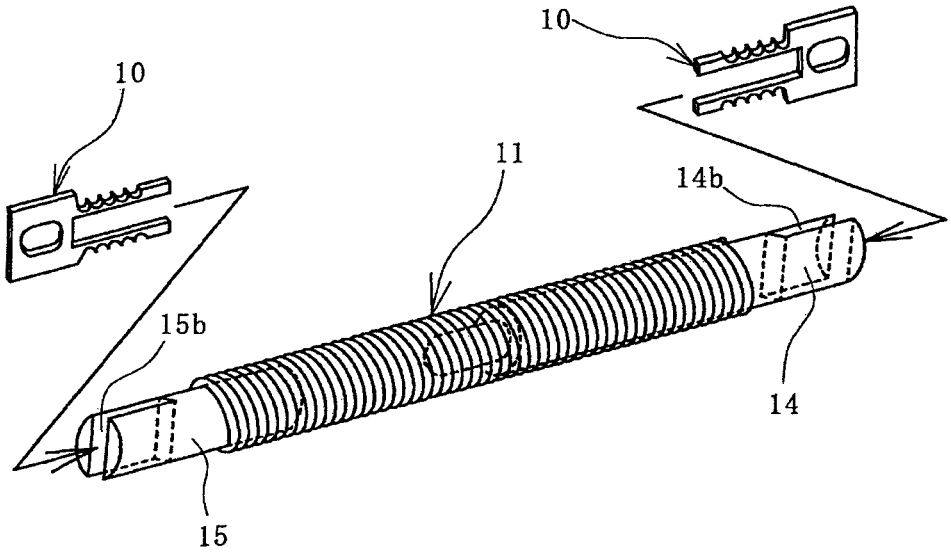
FIG. 8 is an explanatory diagram illustrating a process of inserting an insert shaft into a coil spring.

As illustrated in FIG. 7 and FIG. 8, an insert shaft 13 can be inserted into the coil springs 11. In this embodiment, the insert shaft 13 has a construction such that it is divided into a top part of the divided shaft 14 and a bottom part of the divided shaft 15. The top part of the divided shaft 14 has a protruding part 14*a* in a bottom end part and a cutaway part

14*b* in a top end part. The bottom part of the divided shaft 15 has a recessed part 15*a* in a top end part and a cutaway part 15*b* in a bottom end part. The protruding part 14*a* and the recessed part 15*a* are rotatably mated.

The pin plates 10 are inserted into the cutaway parts 14*b*, 15*b* of the top part of the divided shaft 14 and the bottom part of the divided shaft 15, respectively, the top part of the divided shaft 14 is connected to the pin plate 10 that is inserted in the top end part of the coil spring 11, and the bottom part of the divided shaft 15 is connected to the pin plate 10 that is inserted into the bottom end part of the coil spring 11. The top part of the divided shaft 14 and the bottom part of the divided shaft 15 rotate relatively to each other around the shaft axis and can move along the shaft axial direction inside the coil springs 11.

When the coil springs 11 are twisted due to the opening and closing of the door 2, the coil springs 11 will constrict the insert shaft 13 in addition to the pin plates 10 due to the insert shaft 13 being inserted into the coil springs 11. Thus, the coil springs 11 are supported by the pin plates 10 as well as the insert shaft 13. Therefore, the stress generated in the coil springs 11 is dispersed across a wider region, and durability of the coil springs 11 can be further improved.

In order to effectively increase the durability of the coil springs 11, an outer diameter of the insert shaft 13 is set, for example, within a range from approximately 85% to 90% of an inner diameter of the coil spring 11.

As shown in FIG. 8, because the top part of the divided shaft 14 and the bottom part of the divided shaft 15 are connected to the pin plates 10, when the pin plates 10 rotate due to the opening and closing of the door 2 (i.e. when the coil spring 11 is twisted), the top part of the divided shaft 14 and the bottom part of the divided shaft 15 will rotate in conjunction with the pin plates 10. In this manner, the top part of the divided shaft 14 and the bottom part of the divided shaft 15 will rotate in the same direction as the twisted coil spring 11, reducing the amount of friction between the top part of the divided shaft 14, the bottom part of the divided shaft 15, and the coil spring 11.

Furthermore, the coil springs 11 shrink in length when twisted. Thus, if the top part of the divided shaft 14 and the bottom part of the divided shaft 15 are made so as to be able to move relatively to each other in the shaft axial direction, there will be no additional stress generated in the coil springs 11, leading to even greater advantageousness for improving durability.

The door opening and closing device 4 of the present invention can be used for folding doors installed on lavatories of vehicles such as buses, trains, and ships and the like, in addition to being used in the folding door installed on the aircraft lavatory 1. Furthermore, the present invention is not limited only to the lavatory 1, but can also be used for folding doors installed in various locations such as residential unit bathrooms and the like.

What is claimed is:

1. A door opening and closing device, comprising:

a first closer mechanism and a second closer mechanism incorporated with a longitudinal direction oriented in a vertical direction into each of a first end part and a second end part, respectively, of a pair of hinge pieces that rotatably connect a pair of door panels of a folding door together each closer mechanism comprising:

a coil spring with a longitudinal direction oriented in the vertical direction;

a first pin plate and a second pin plate attached to the coil spring, the first pin plate partially inserted into a first end part of the coil spring, the second pin plate partially inserted into a second end part of the coil spring; wherein the first and second pin plates each comprise a plurality of engagement grooves configured to engage with an inner circumferential surface of the coil spring; and a bracket that fixedly connects one of the hinge pieces to the first pin plate;

wherein the folding door is closed by a restoring force generated by a twisting of the coil springs.

2. The door opening and closing device according to claim 1, wherein each closing mechanism further comprises a shaft that is inserted into the coil springs.

3. The door opening and closing device according to claim 2, wherein the shaft is divided part way in the longitudinal direction and a first part of the divided shaft is connected to the first pin plate that is inserted into the first end part of the coil spring, and a second part of the divided shaft is connected to the second pin plate that is inserted into the second end part of the coil spring.

4. The door opening and closing device according to claim 3, wherein the first part of the divided shaft and the second part of the divided shaft can move relatively to each other in a shaft axial direction.

5. The door opening and closing device according to claim 1, wherein an outer diameter of the coil springs is from approximately 9 mm to 15 mm.

6. The door opening and closing device according to claim 1, wherein a length of the coil springs is from approximately 100 mm to 120 mm.

7. The door opening and closing device according to claim 1, wherein a length of the pin plates is from approximately 10 mm to 15 mm.

8. The door opening and closing device according to claim 1, wherein each of the first and second pin plates comprise an elongate hole that protrudes from the coil spring.

9. The door opening and closing device according to claim 8, wherein each closing mechanism further comprises:

a fitting configured to receive a portion of the first pin plate with the elongate hole; and a pin configured to pass through the fitting and the elongate hole to attach the fitting to the first pin plate.

10. The door opening and closing device according to claim 9, wherein the fitting comprises a cam interposed in a first part of the fitting, the cam comprising a fan-shaped cutaway corresponding to a fan-shaped cutaway in a housing for receiving the coil spring and the first and second pin plates, wherein the fan-shaped cutaways of the cam and the housing comprising interlocking cutaways to restrict an angle of rotation of the cam.

11. The door opening and closing device according to claim 1, wherein each closing mechanism further comprises an insert shaft configured to be inserted into the coil spring.

12. The door opening and closing device according to claim 11, wherein the insert shaft comprises a divided first portion and a divided second portion, the divided first and bottom portions being separable one from another.

13. The door opening and closing device according to claim 12, wherein the divided first portion comprises a protrusion in a second end, the divided second portion comprises a recess in a first end, and the protrusion and recess are rotatably mated.

14. The door opening and closing device according to claim 12, wherein the divided first portion is divided by a cutaway in a first end and the divided second portion is divided by a cutaway in a second end, the cutaways in the divided first and second portions being configured to receive the first and second pin plates inserted into the coil spring.

15. The door opening and closing device according to claim 11, wherein the insert shaft comprises a diameter within a range from approximately 85% to 90% of an inner diameter of the coil springs.

16. A folding door, comprising:

a plurality of door panels; and a door opening and closing device, comprising:

a first closer mechanism and a second closer mechanism incorporated with a longitudinal direction oriented in a vertical direction into each of a first end part and a second end part, respectively, of a pair of hinge pieces that rotatably connect the plurality of door panels of the folding door together, each closer mechanism comprising;

a coil spring with a longitudinal direction oriented in the vertical direction;

a first pin plate and a second pin plate attached to the coil spring, the first pin plate partially inserted into a first end part and the second pin plate partially inserted into a second end part of the coil spring and protruding out in the longitudinal direction of the coil spring, that are attached to the coil spring, wherein the first and the second pin plate each comprises a plurality of engagement grooves configured to engage with an inner circumferential surface of the coil spring; and a bracket fixedly connecting one of the hinge pieces to the first pin plate;

wherein the folding door is closed by a restoring force generated by a twisting of the coil spring.

17. The folding door according to claim 16, wherein the plurality of door panels comprise a curved surface expanding outward in an arc shape.

18. The folding door according to claim 16, wherein the plurality of door panels comprises a flat surface.

19. The folding door according to claim 16, wherein the hinge pieces are fixed to opposing side surfaces of the door panels, the hinge pieces comprising interlocking first and second ends.

20. The folding door according to claim 16, wherein the folding door comprises an airplane lavatory folding door.

* * * * *